US010435937B2

(12) United States Patent
Savage et al.

(10) Patent No.: US 10,435,937 B2
(45) Date of Patent: Oct. 8, 2019

(54) DOOR ASSEMBLY FOR STORAGE AND DISPENSING UNIT

(71) Applicants: Kent V. Savage, Morrow, OH (US); Benjamin V. Savage, Loveland, OH (US)

(72) Inventors: Kent V. Savage, Morrow, OH (US); Benjamin V. Savage, Loveland, OH (US)

(73) Assignee: APEX INDUSTRIAL TECHNOLOGIES LLC, Mason, OH (US)

( * ) Notice: Subject to any disclaimer, the term of this patent is extended or adjusted under 35 U.S.C. 154(b) by 213 days.

(21) Appl. No.: 15/083,358

(22) Filed: Mar. 29, 2016

(65) Prior Publication Data

US 2016/0208543 A1 Jul. 21, 2016

Related U.S. Application Data

(62) Division of application No. 13/315,455, filed on Dec. 9, 2011, now Pat. No. 9,322,207.

(Continued)

(51) Int. Cl.

*E05G 1/04* (2006.01)
*E05G 1/06* (2006.01)

(Continued)

(52) U.S. Cl.

CPC ..... *E06B 3/362* (2013.01); *A47B 81/00* (2013.01); *A47B 96/00* (2013.01); *E05B 1/0092* (2013.01); *E05B 47/0001* (2013.01); *E05B 47/0657* (2013.01); *E05B 49/00* (2013.01); *E05B 65/006* (2013.01); *E05B 65/06* (2013.01); *E05G 1/04* (2013.01); *E05G 1/08* (2013.01); *E06B 7/00* (2013.01); *A47G 29/141* (2013.01); *E05B 65/025* (2013.01); *E05G 1/02* (2013.01); *E05G 1/024* (2013.01); *E05G 1/026* (2013.01); *E05G 1/06* (2013.01)

(58) Field of Classification Search

CPC .... E05B 3/362; E05B 65/006; E05B 47/0001; E05B 49/00; E05B 65/06; E05B 47/0657; E05B 1/0092; E05B 65/025; E06B 7/00; E06B 3/362; A47B 96/00; A47B 81/00; E05G 1/04; E05G 1/08; E05G 1/06; E05G 1/026; E05G 1/024; E05G 1/02; A47G 29/1201; A47G 29/141

USPC ..... 109/53, 56, 57, 69–73; 232/24, 25; 312/257.1, 351; 700/231, 242

See application file for complete search history.

(56) References Cited

U.S. PATENT DOCUMENTS 93,006 A 7/1869 Roberts
618,846 A 2/1899 Crowder (Continued)

OTHER PUBLICATIONS

PCT, International Search Report and Written Opinion, International Application No. PCT/US2011/064092 (dated Apr. 2, 2012).

*Primary Examiner* — Lloyd A Gall
(74) *Attorney, Agent, or Firm* — Thompson Hine LLP

(57) ABSTRACT

A storage and dispensing system including a frame defining a plurality of compartments and a door assembly including a plurality of doors. Each door is sized to generally correspond to one of the compartments of the frame to selectively provide access thereto, and the door assembly is removably coupled to the frame.

24 Claims, 18 Drawing Sheets

Related U.S. Application Data

(60) Provisional application No. 61/421,558, filed on Dec. 9, 2010.

(51) Int. Cl.

| | |
|---|---|
| ***E06B 3/36*** | (2006.01) |
| ***E05B 1/00*** | (2006.01) |
| ***E05B 47/06*** | (2006.01) |
| ***E05G 1/08*** | (2006.01) |
| ***A47B 81/00*** | (2006.01) |
| ***A47B 96/00*** | (2006.01) |
| ***E05B 47/00*** | (2006.01) |
| ***E05B 49/00*** | (2006.01) |
| ***E05B 65/00*** | (2006.01) |
| ***E05B 65/06*** | (2006.01) |
| ***E06B 7/00*** | (2006.01) |
| *A47G 29/14* | (2006.01) |
| *E05G 1/02* | (2006.01) |
| *E05G 1/024* | (2006.01) |
| *E05G 1/026* | (2006.01) |
| *E05B 65/02* | (2006.01) |

(56) References Cited

U.S. PATENT DOCUMENTS 652,279 A 6/1900 Lauer
768,100 A 8/1904 Walsh
892,514 A 7/1908 Fuller
1,103,166 A 7/1914 Williams
1,252,790 A 1/1918 Dick et al.
1,324,018 A 12/1919 Mumbrauer
1,684,513 A * 9/1928 Parker ..... A47G 29/1201 232/25
1,750,339 A * 3/1930 Wood ..... A47G 29/1201 232/24
2,010,237 A 8/1935 Joseph
2,424,217 A * 7/1947 Bales ..... A47B 47/03 211/135
2,508,159 A * 5/1950 Haas ..... G07D 11/009 109/53
2,598,255 A 5/1952 Henkel
2,996,322 A 8/1961 McClellan
3,316,041 A * 4/1967 Nelson ..... A47F 3/005 220/665
3,370,521 A * 2/1968 Honerkamp ..... F24C 15/08 165/55
3,421,461 A 1/1969 St. Clair et al.
3,544,185 A * 12/1970 Lundberg ..... A47B 47/03 108/156
3,837,299 A * 9/1974 McClellan ..... A47B 47/00 109/53
3,893,740 A 7/1975 England
4,073,554 A * 2/1978 Oder ..... A47B 87/02 109/53
4,161,274 A 7/1979 Bishop et al.
4,171,662 A * 10/1979 Simone ..... F16B 23/0076 411/408
4,548,330 A 10/1985 Hewitt et al.
4,608,932 A * 9/1986 Bohland ..... E05G 1/08 109/53
4,648,550 A * 3/1987 Cleary, Jr. ..... A47G 29/1201 109/56
4,669,767 A 6/1987 Leto
4,852,503 A 8/1989 Lichter
4,947,766 A * 8/1990 Collier, Jr. ..... E05G 1/08 109/56
4,953,327 A 9/1990 Cohodar
5,205,628 A 4/1993 Swets et al.
5,267,688 A * 12/1993 Benefield ..... A47G 29/1201 232/17
5,333,949 A 8/1994 McGregor
5,435,255 A * 7/1995 Elseser ..... E05G 1/08 109/56
5,532,521 A * 7/1996 Leininger ..... B60P 3/03 180/289
5,701,828 A * 12/1997 Benore ..... E05B 47/0002 109/53
5,716,114 A 2/1998 Holmes et al.
5,784,973 A 7/1998 Mercer et al.
6,705,136 B2 3/2004 Porter
6,749,109 B2 * 6/2004 Hill ..... A47G 29/1201 232/24
7,086,258 B2 8/2006 Fisher et al.
7,484,391 B1 2/2009 Moore
9,322,207 B2 * 4/2016 Savage ..... E05B 1/0092
9,663,974 B2 * 5/2017 Savage ..... E05B 65/025
2002/0070640 A1 6/2002 Hamilton et al.
2005/0121509 A1 6/2005 McCracken et al.
2005/0179349 A1 * 8/2005 Booth ..... E05B 47/026 312/257.1
2006/0060114 A1 3/2006 Walker
2006/0152339 A1 7/2006 Mercier et al.
2006/0255116 A1 * 11/2006 Yong ..... A47G 29/1201 232/24
2010/0026147 A1 2/2010 Mackillop
2010/0223857 A1 * 9/2010 Sutton ..... A47B 46/005 52/27
2013/0193818 A1 8/2013 Sturm et al.

* cited by examiner

DOOR ASSEMBLY FOR STORAGE AND DISPENSING UNIT

This application is a divisional of U.S. Pat. No. 9,322,207, issued on Apr. 26, 2016, which claims priority to U.S. Provisional Patent Application Ser. No. 61/421,558, filed on Dec. 9, 2010. The entire contents of both this patent and this application are incorporated herein by reference.

The present invention is directed to a door assembly, and more particularly, to a door assembly that is removably attachable to a frame.

BACKGROUND

Self-service storage and dispensing units often include a door, access panel or the like to provide the user access to an inner storage compartment of the unit. However, existing doors may not provide fail-safe operation in that, for example, the door may not be properly secured in the closed position. In addition, existing doors may provide insufficient security features and be vulnerable to being pried open with a crowbar or the like. Finally, existing door assemblies may be difficult to access for repair, maintenance or the like.

SUMMARY

In one embodiment the present invention is a storage and dispensing system including a frame defining a plurality of compartments and a door assembly including a plurality of doors. Each door is sized to generally correspond to one of the compartments of the frame to selectively provide access thereto, and the door assembly is removably coupled to the frame.

DETAILED DESCRIPTION

Figure 1:
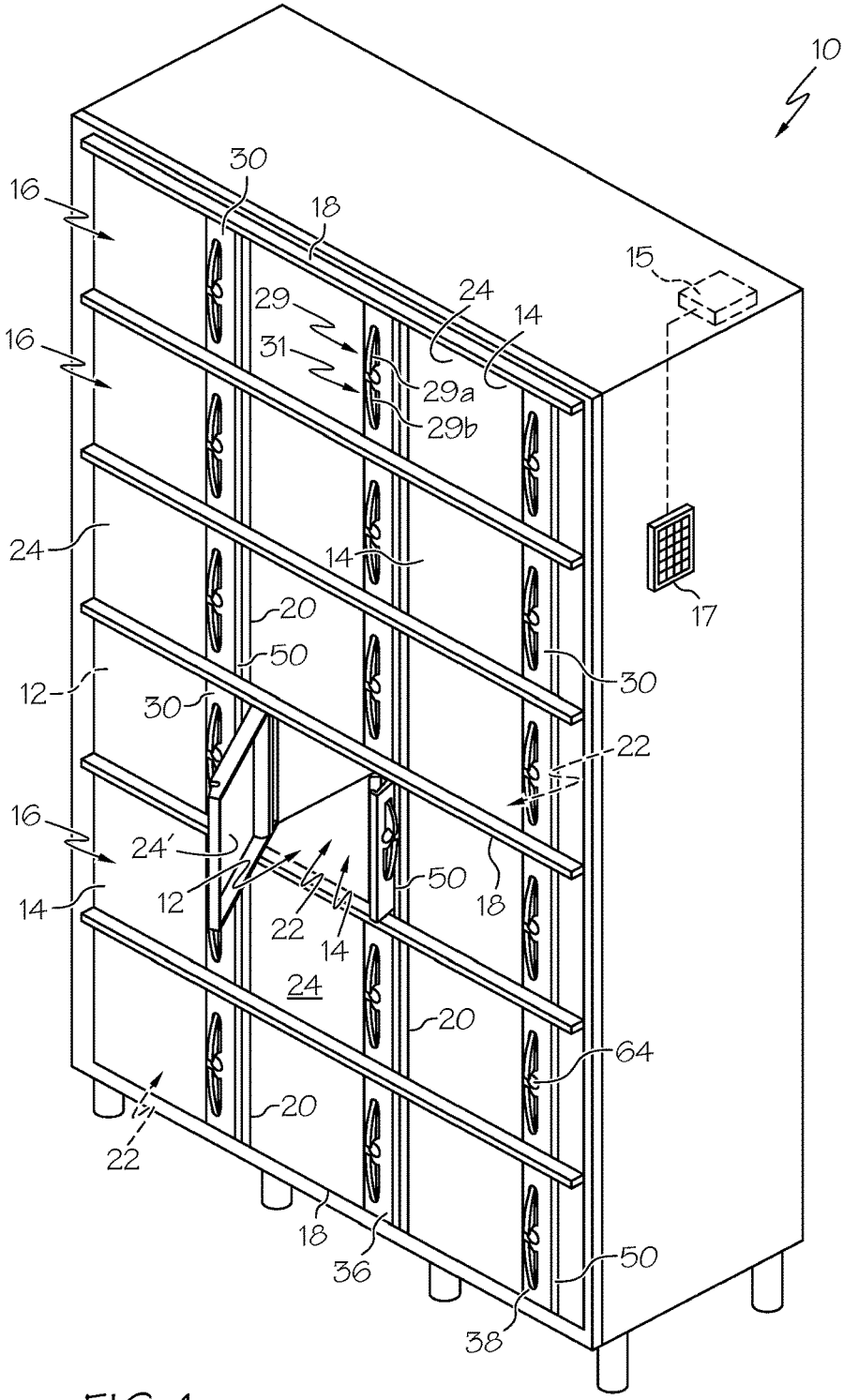
FIG. 1 is a front perspective view of a storage cabinet incorporating one embodiment of the door assembly of the present invention.

FIG. 1 illustrates a storage cabinet 10 which can be utilized to store and/or dispense any of a wide variety of products. For example, in one embodiment, the storage cabinet 10 includes various compartments 12, each covered by a door assembly 14 which can be selectively opened by a user or users in a locker-like configuration. The storage cabinet 10 can be configured to selectively control access to the compartments 12 by allowing selective opening of the door assemblies 14 by users. In one case, the storage cabinet 10 may have a controller 15 which a user can interact with to gain access to all or certain ones of the compartments 12. The controller may take the form of a processor, CPU, computer or the like, and may include a user interface 17 in the form of a keypad, touch screen, keyboard, mouse, track ball, audio input device, or the like.

When a user wishes to access and withdraw an item from, or replace/replenish an item to, the storage cabinet 10, the user may, in some cases, need to first be identified and/or authenticated (i.e. via an identification system and authentication system/database). The identification/authentication can be implemented or carried out in a variety of manners, including by the use of a user identification and/or password, the use of a key fob or other wireless device which transmits in the radio frequency range, a mechanical or electronic key, the use of a mobile phone or device, a card with a magnetic strip in conjunction with a magnetic strip/card reader, the use of biometrics, or various other means or mechanisms. Moreover, the door assembly 14 disclosed herein can be used in a variety of other settings in which it is desired to control access to a locker or storage compartment 12 such as, for example, coin-operated lockers or the like.

Figure 2:
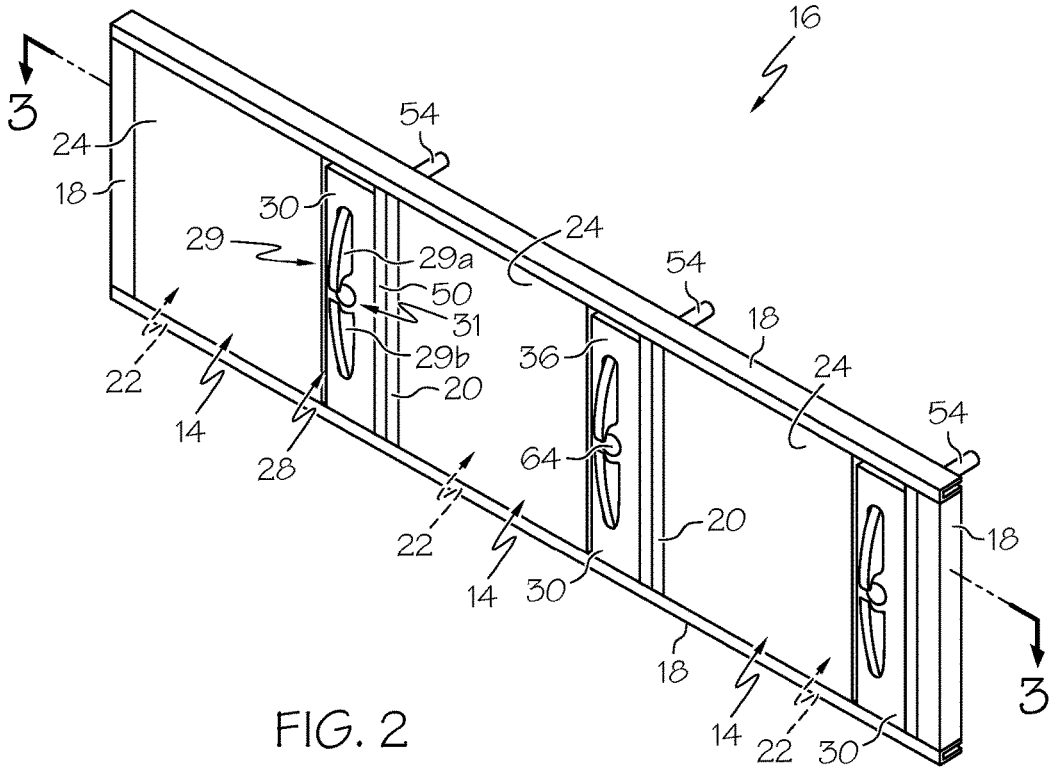
FIG. 2 is a front perspective view of a door panel of the storage cabinet of FIG. 1.
Figure 3:
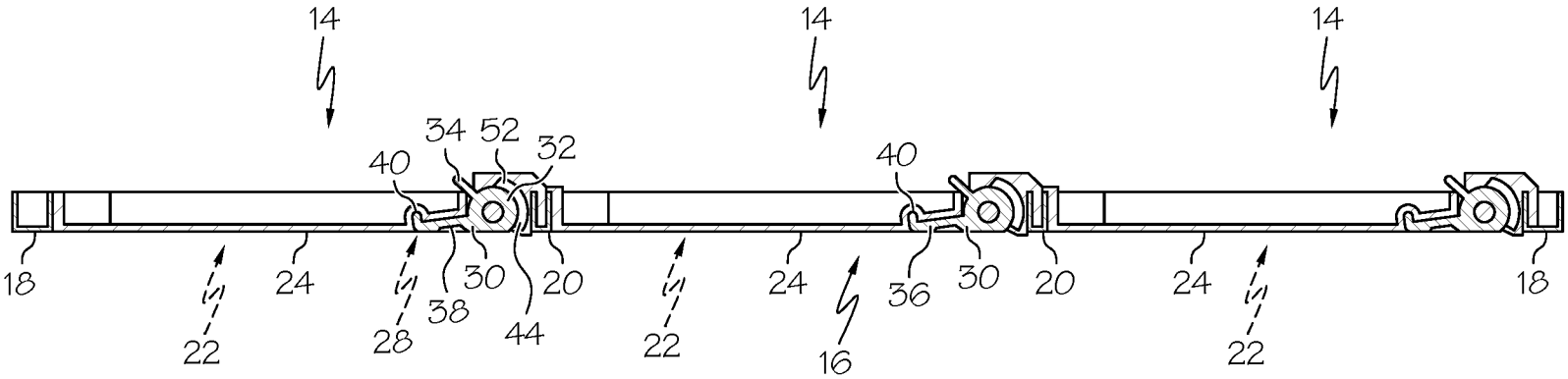
FIG. 3 is a cross section of the door panel of FIG. 2, taken along line 3-3 of FIG. 2.

FIGS. 2 and 3 illustrate a door panel 16 having a generally rectangular door panel frame 18 extending about the periphery thereof. The door panel frame 18 includes two vertically oriented dividers 20 such that the illustrated door panel 16 includes three openings 22, each opening 22 being associated with a compartment 12 of the storage cabinet 10. The door panel 16 of FIGS. 2 and 3 includes three door assemblies 14 arranged in a side-by side configuration, with each door assembly 14 extending across and selectively covering an associated opening 22 of the door panel frame 18.

Figure 4:
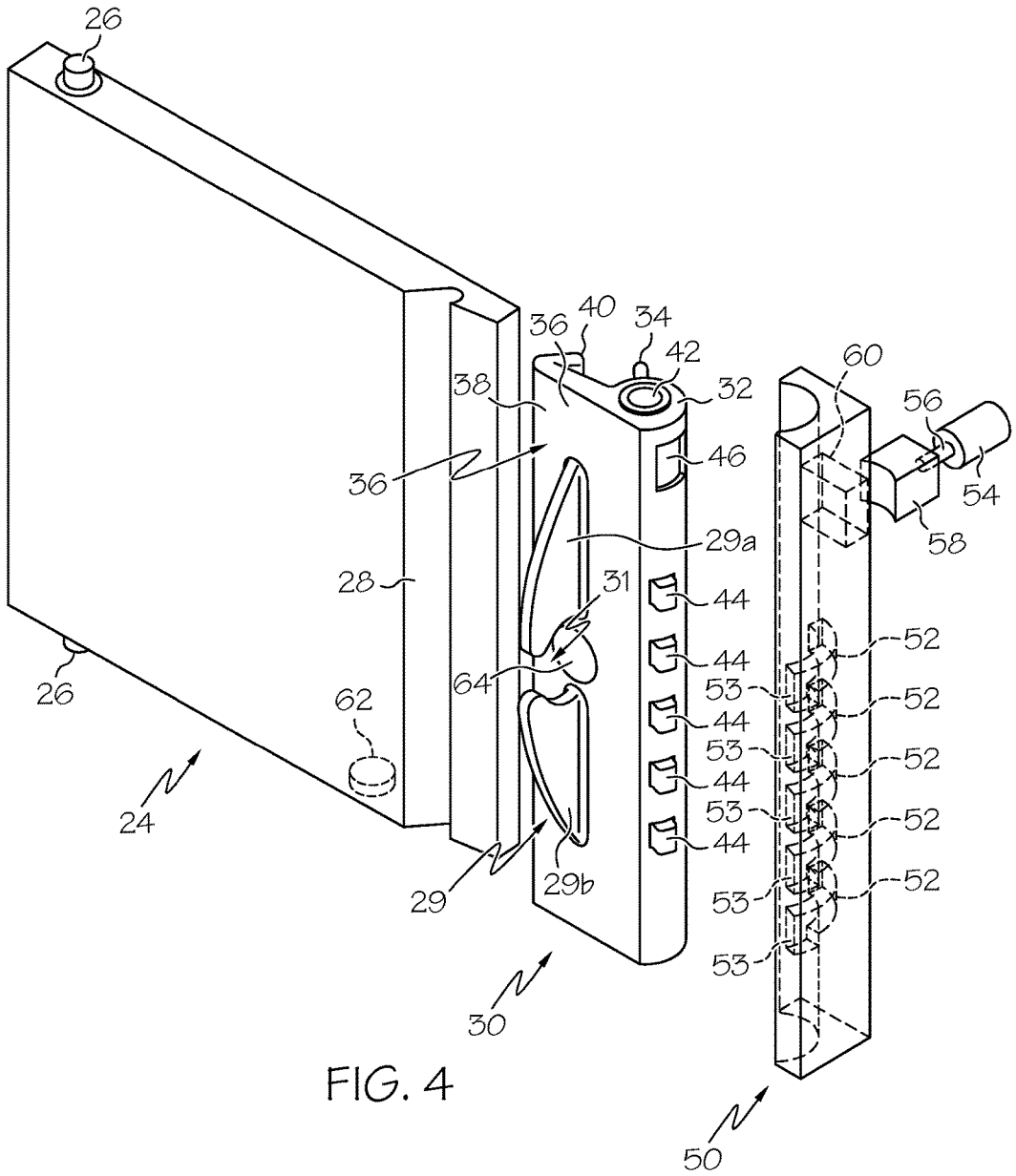
FIG. 4 is a front perspective exploded view of a door assembly of the door panel of FIG. 2.

Each door assembly 14 includes a generally flat, rectangular main panel 24 which extends across the majority of the opening 22/compartment 12. As shown in FIG. 4, the main panel 24 may include a pair of aligned cylindrical protrusions 26 extending generally outwardly therefrom. Each protrusion 26 is received in a corresponding opening of the door panel frame 18 to pivotally mount the main panel 24 to the door panel frame 18. In this manner, when conditions are appropriate (as described below), the main panel 24 can pivot about a vertical axis between its closed position (shown as all of the main panels 24 in FIG. 1, except main panel 24') wherein the main panel 24 is positioned across the opening 22/compartment 14 to block access thereto, and an open position (shown as main panel 24' in FIG. 1) wherein the main panel 24 is not positioned across the opening 22/compartment 14 to allow access thereto.

Figure 17:
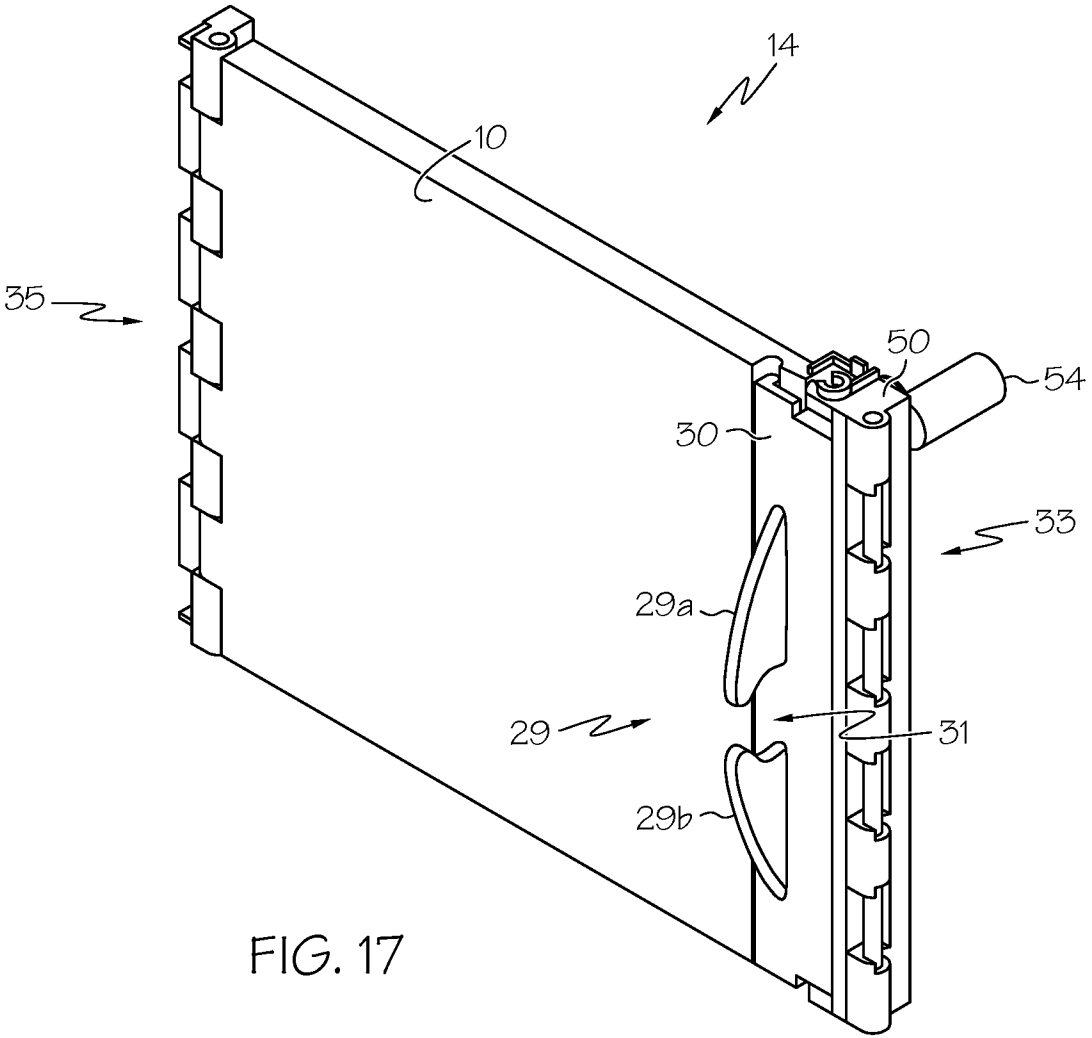
FIG. 17 is a front perspective view of an alternate door assembly.

However, it should be understood that the main panel 24 can be pivotally mounted by any of a wide variety of mechanisms, such as by hinges, by reversing the position of the protrusions 26 and openings (i.e. such that the protrusions 26 are positioned on the frame 18) etc. For example, FIG. 17 shows an alternate hinge arrangement in which a block 50 of the door assembly 14 includes part of a hinge mechanism 33 formed therein, and the opposite side of the main panel 24 includes a corresponding hinge portion 35 configured to engage the hinge portion 33 of another door assembly 14 to form a hinge. In this manner the block 50 for one door assembly 14 can form part of the hinge for an adjacent door assembly 14.

Figure 7:
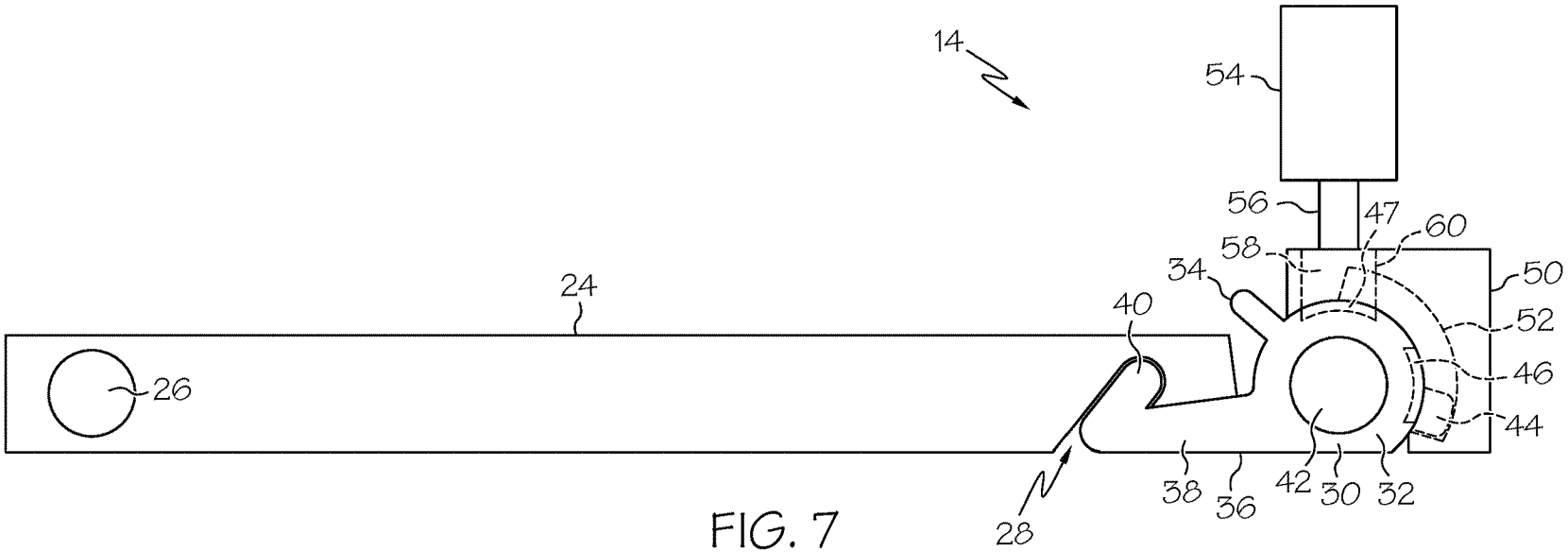
FIG. 7 is a top view of the door assembly of FIG. 6.

With reference to FIGS. 4 and 7, it can be seen that each main panel 24 may include a vertically-extending groove or notch 28 formed in a front surface thereof, and extending partially therethrough. In the embodiment of FIGS. 4 and 7, the notch 28 extends at an acute angle, angling back towards a handle 30 of the door assembly 14. However, the notch 28 can be positioned at various other angles, including generally perpendicular to the front surface of the main panel 24, as shown in FIG. 3.

Figure 5:
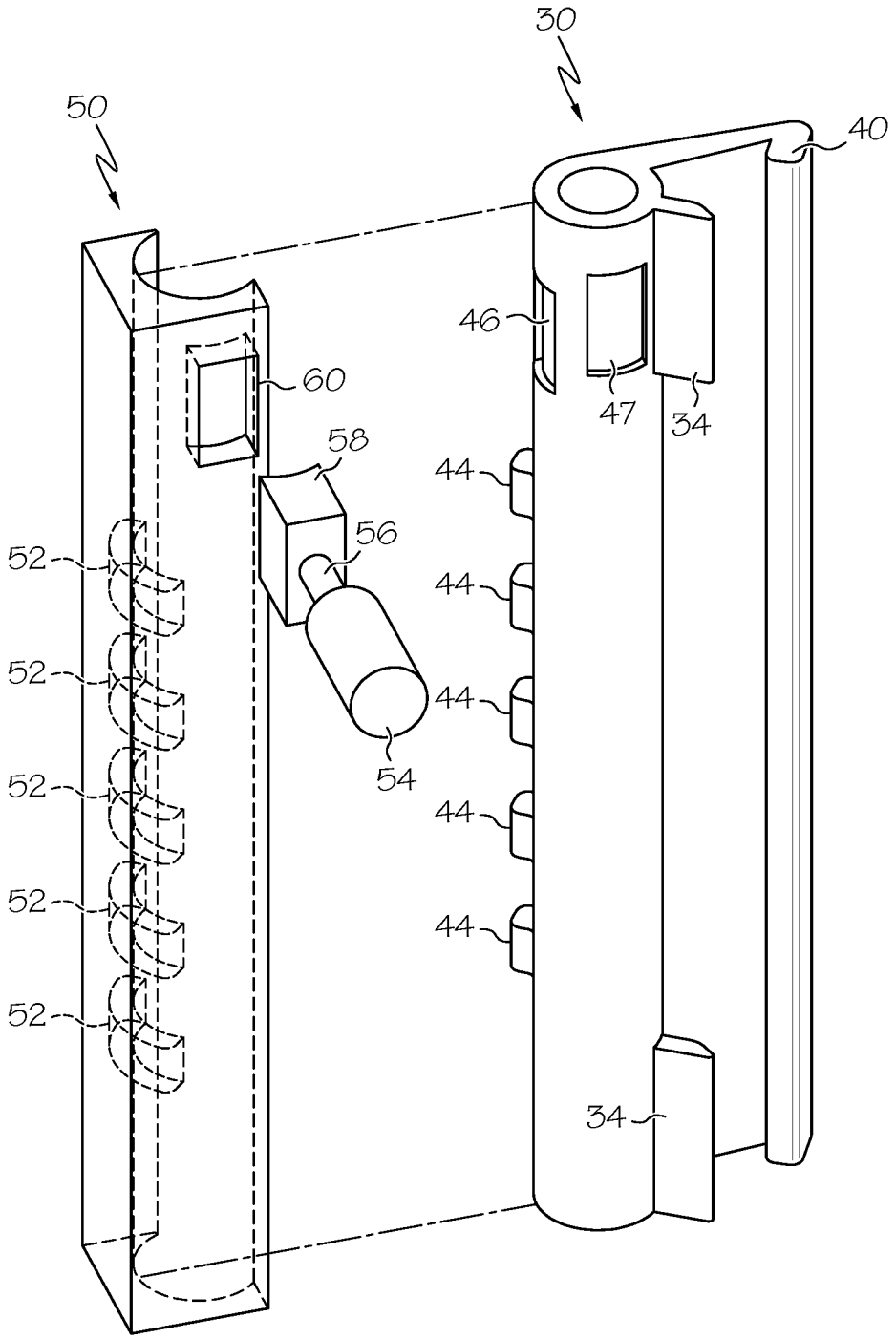
FIG. 5 is rear view of part of the door assembly of FIG. 4.

The door assembly 14 further includes the handle 30 mounted to the door panel frame 18 and positioned adjacent to the main panel 24. The handle 30 includes a generally cylindrical portion 32, a rear tab 34 or kick plate extending generally radially outwardly from the cylindrical portion 32 and a front tab 36 extending generally radially outwardly from the cylindrical portion. The front tab 36 includes a base portion 38, extending generally away from the cylindrical portion 32, and a locking portion 40 generally forming an angle with the base portion 38. In the embodiment shown in FIG. 4, the locking portion 40 generally forms an acute angle with the base portion 38 and angles somewhat back towards the cylindrical portion 32, matching the angle of the notch 28. If desired, the position of the notch 28 and locking portion 40 may be reversed such that the notch 28 is carried on the handle 30 and the locking portion 40 is carried on the main panel 24. As shown in FIG. 5, in one embodiment, the rear tab 34 is discontinuous, and does not extend the entire height of the handle 30.

The handle 30 is pivotally and vertically slidably mounted to the door panel frame 18. In particular in one embodiment the cylindrical portion 32 of the handle 30 receives a post 42 therein, which is fixedly coupled to the frame 18. In this manner the handle 30 is pivotally mounted to the frame 18 such that, when conditions are appropriate (as described below), the handle 30 can pivot about a vertical axis between its closed position (FIG. 6-10) and its fully open position (FIGS. 13-16). Thus, the handle 30 and main panel 24 are pivotable about axes that are generally parallel but spaced apart. However, the handle 30 can be pivotally and axially slidably mounted to the frame 18 in any of a wide variety of other manners.

As shown in FIG. 4, the handle 30 may include a gripping portion 29 which can include a top portion 29*a* and bottom portion 29*b* separated by a space 31. The gripping portion 29 is configured such that a user can insert a digit into the space 31, and thereby lift the gripping portion 29, lifting the handle 30 vertically.

The cylindrical portion 32 of the handle 30 includes a plurality of radially outwardly extending, axially spaced protrusions 44. In addition, the cylindrical portion 32 of the handle includes an open position recess 46 (FIG. 4) and a closed position recess 47 (FIG. 5) formed therein, and positioned near a top of the handle 30 in the illustrated embodiment.

Each door assembly 14 further includes a block 50 positioned between the handle 30 and a divider 20 of the door panel frame 18. In the illustrated embodiment the block 50 is fixedly coupled to the door panel frame 18, and positioned immediately adjacent to the handle 30. As best shown in FIGS. 4 and 5, the block 50 includes a plurality of vertically spaced, circumferentially-extending recesses 52 formed therein. Each recess 52 may also be connected to an associated downwardly extending notch 53 at an end thereof.

Each door assembly 14 may include a solenoid, transducer or other activatable component 54 associated therewith and operatively coupled to the controller 15. With reference to FIGS. 4 and 5, each solenoid 54 includes an extendible/retractable plunger 56 with a pad 58 at the end thereof. The plunger 56 and pad 58 are positioned to extend through an opening 60 of the block 50. In the illustrated embodiment, the solenoid 54 is configured such that when the solenoid 54 is activated, the plunger 56 and pad 58 are retracted, and when the solenoid 54 is not activated, the plunger 56 and pad 58 are extended.

The door assembly 14 may include a door position sensor 62 (see FIG. 4) configured to sense or detect the position of the main panel 24, and more particularly, when the main panel 24 is at, or relatively close to, its closed position or close to the handle 30 (in a nearly-closed position). The door position sensor 62 is operatively coupled to the controller 15 and/or associated solenoid 54. In one particular embodiment, the door position sensor 62 takes the form of a magnetic switch positioned adjacent to the bottom of the main panel 24, with a corresponding component, such as a magnet and/or magnetic switch (not shown) on the frame 18. However, the door/position sensor 62 can take any wide variety of forms, including but not limited to pressure or force sensors, optical sensors, contact sensors, photoelectric sensors, ultrasonic sensors, piezoelectric sensors, proximity sensors, electric field sensors or the like.

Each door assembly 14 may further include a light source 64 positioned therein. In the illustrated embodiment, the light source 64 takes the form of a lighted button or light bar positioned in the handle 30 such that, when activated, the light source 64 generally illuminates the entire handle 30. However, the light source 64 can be positioned at different areas within the door assembly 14.

Each door panel 16 can be made from any of a wide variety of materials. In one embodiment, however, the door panel frame 18 and/or block 50 are made of a relatively strong, rigid material, such as metal (including aluminum), and the main panel 24, handle 30 and/or block 50 are made of relatively strong, lightweight material, such as plastic. In one embodiment, the main panel 24 and/or handle 30 are each made of a generally clear or transparent material, or a mesh material, to allow the contents of the storage compartment 12 to be visible through the door assembly 14. However, if desired the main panel 24 and/or handle 30 may be generally opaque.

Figure 6:
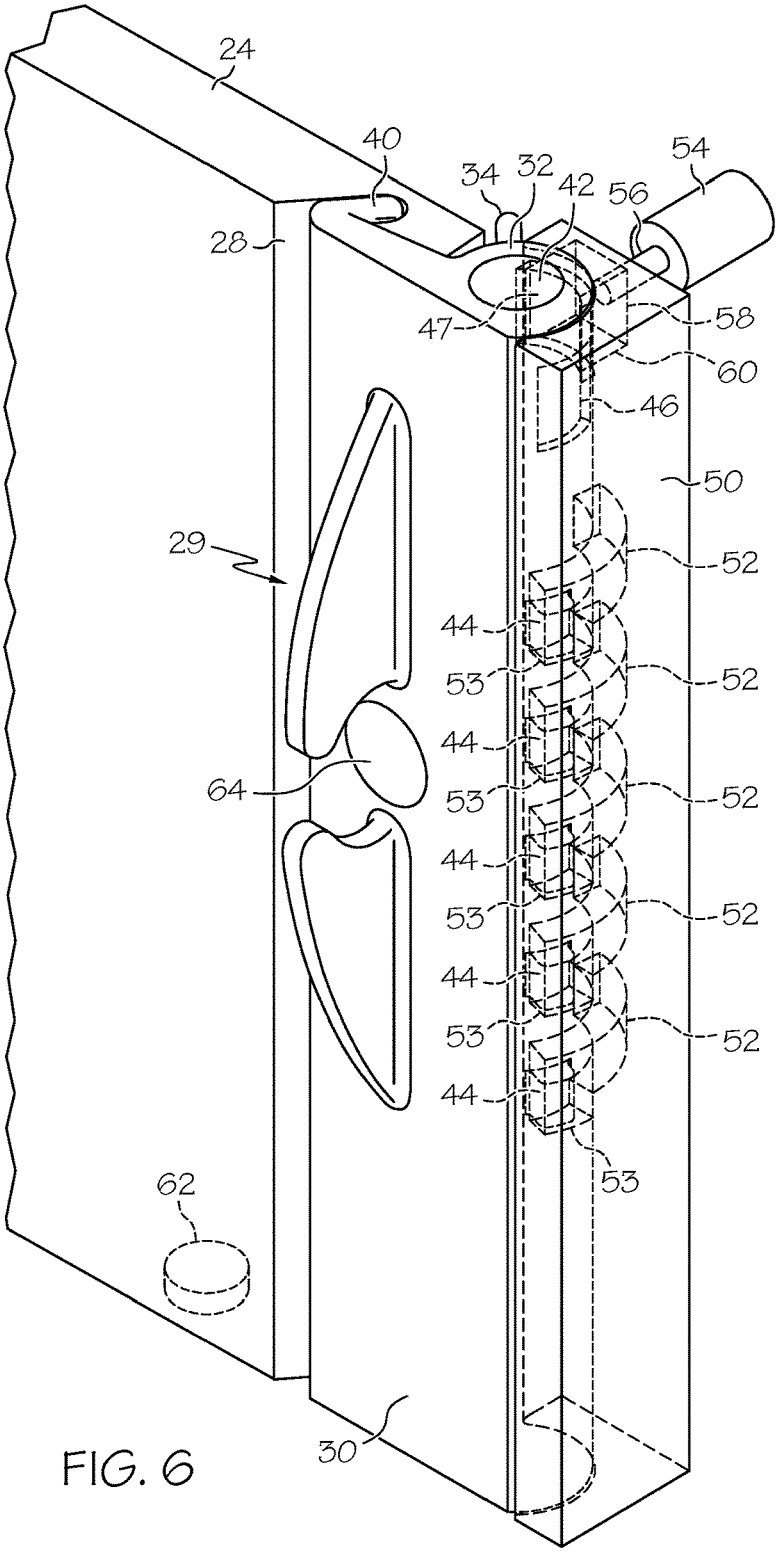
FIG. 6 is a front detailed perspective view of the door assembly of FIG. 4, shown in its assembled condition.

When a user first approaches a door assembly 14, the door assembly 14 will typically be locked in its closed position. When the door assembly 14 is in the closed position the main panel 24 and handle 30 are both closed and extend across the opening 22, and the locking portion 40 of the handle 30 is received in the notch 28 of the main panel 24, as shown in FIG. 6. Thus the interaction of the locking portion 40 and the notch 28 helps to couple the handle 30 and main panel 24 together when they are in the closed position.

When the user first approaches the door assembly 14, the handle 30 is typically in its lower position. In this case, the protrusions 44 of the handle 30 are received in the end notches 53, and the protrusions 44 are misaligned with the recesses 52 of the block 50. In addition, the solenoid 54 is in its deactivated (i.e. extended) position. When the handle 30 is in its lower position, any attempted pivoting or opening of the handle 30 is blocked due to the protrusions 44 of the handle 30 engaging the block 50. Thus, when the handle 30 is in its lower position the handle 30 is blocked from rotating, and the door assembly 14 is also blocked from rotating. Moreover, as shown in FIGS. 6 and 7, when the solenoid 54 is deactivated, the pad 58 is positioned in the recess 47 of the handle 30, and therefore blocks the handle 30 from being raised.

Thus, in this position the pad 58 blocks the handle 30 from being raised, which in turn blocks the handle 30 from rotating, which in turn prevents the door assembly 14 from being opened. Various other arrangements may also or instead be utilized for blocking the handle 30 from being raised. For example, in one case the pad 58 may be positioned just above the top of the handle 30 when the handle 30 is in its lower position. Moreover, if desired, the position of the protrusions 44 and recesses 52 can be reversed such that the recesses 52 are positioned on the handle 30, and the protrusions 44 are positioned on the block 50.

Figure 8:
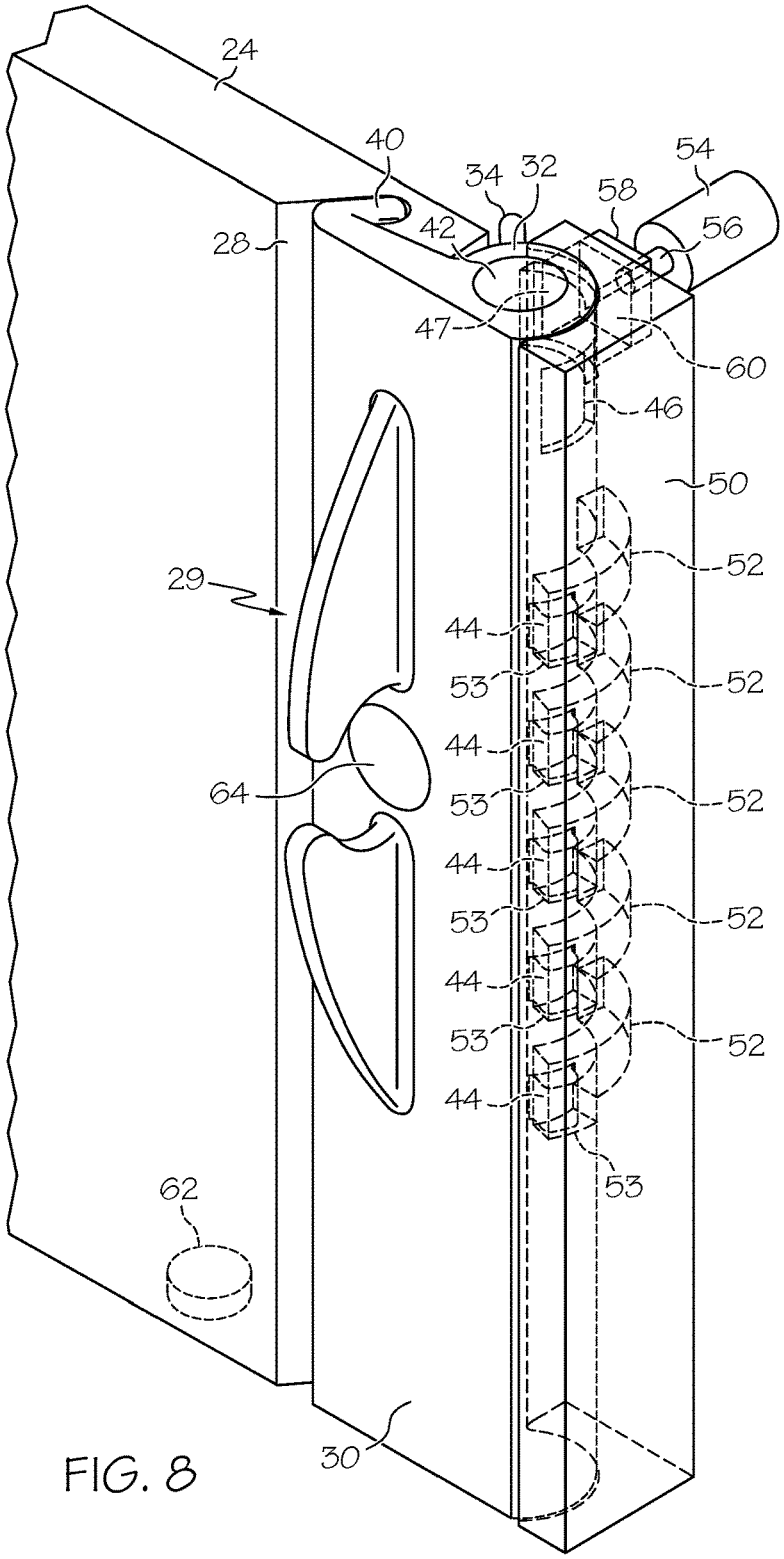
FIG. 8 shows the door assembly of FIG. 6, with the plunger retracted.
Figure 9:
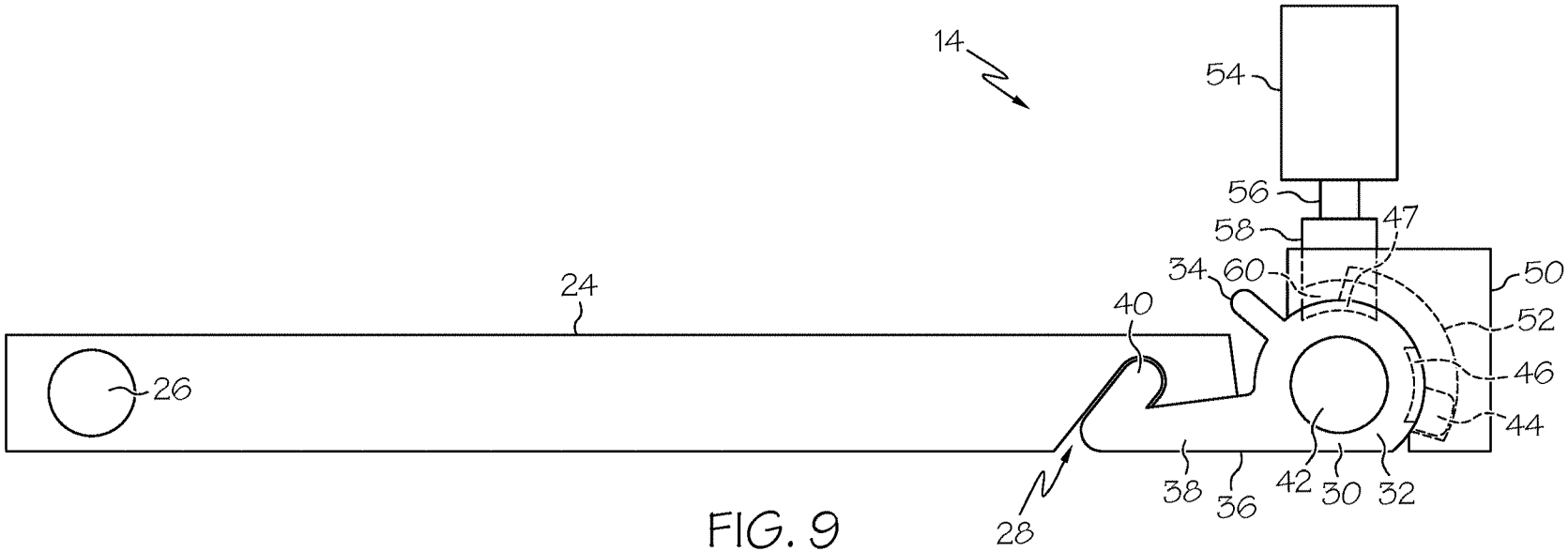
FIG. 9 is a top view of the door assembly of FIG. 8.

When the user is granted access to the door/assembly 14/inner compartment 12, the solenoid 54 is activated (i.e. by receipt of an unlock signal from the controller 15) and the pad 58 is retracted out of the recess 47 (FIGS. 8 and 9). At the same time, the light source 64 for that door assembly 14 may be activated so that the user is cued that he or she has access to the door assembly 14/inner compartment 12. When the solenoid 54/pad 58 is retracted, the user can then engage and lift the handle 30 to its upper position (FIG. 10), such as by the gripping portion 29. When the handle 30 is lifted, the protrusions 44 of the handle 30 become axially/vertically aligned with the recesses 52 on the block 50, thereby allowing the handle 30 to pivot. If desired, the handle 30/block 50 can be arranged such that the handle 30 is pressed downwardly (i.e. compressing a spring, in one case) instead of upwardly in order to align the protrusions 44 with the recesses 52.

Figure 11:
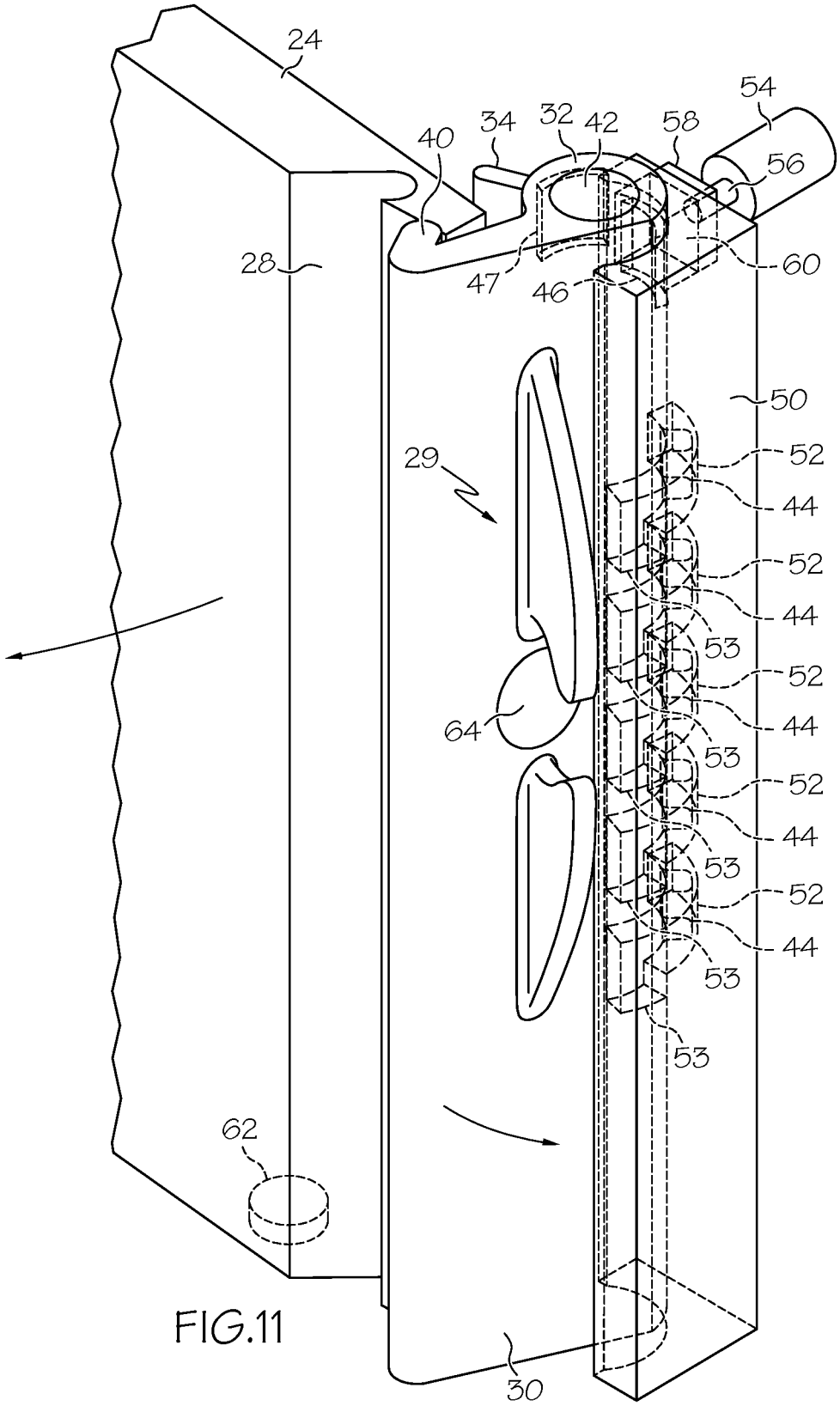
FIG. 11 shows the door assembly of FIG. 10, with the handle and main panel slightly opened.
Figure 12:
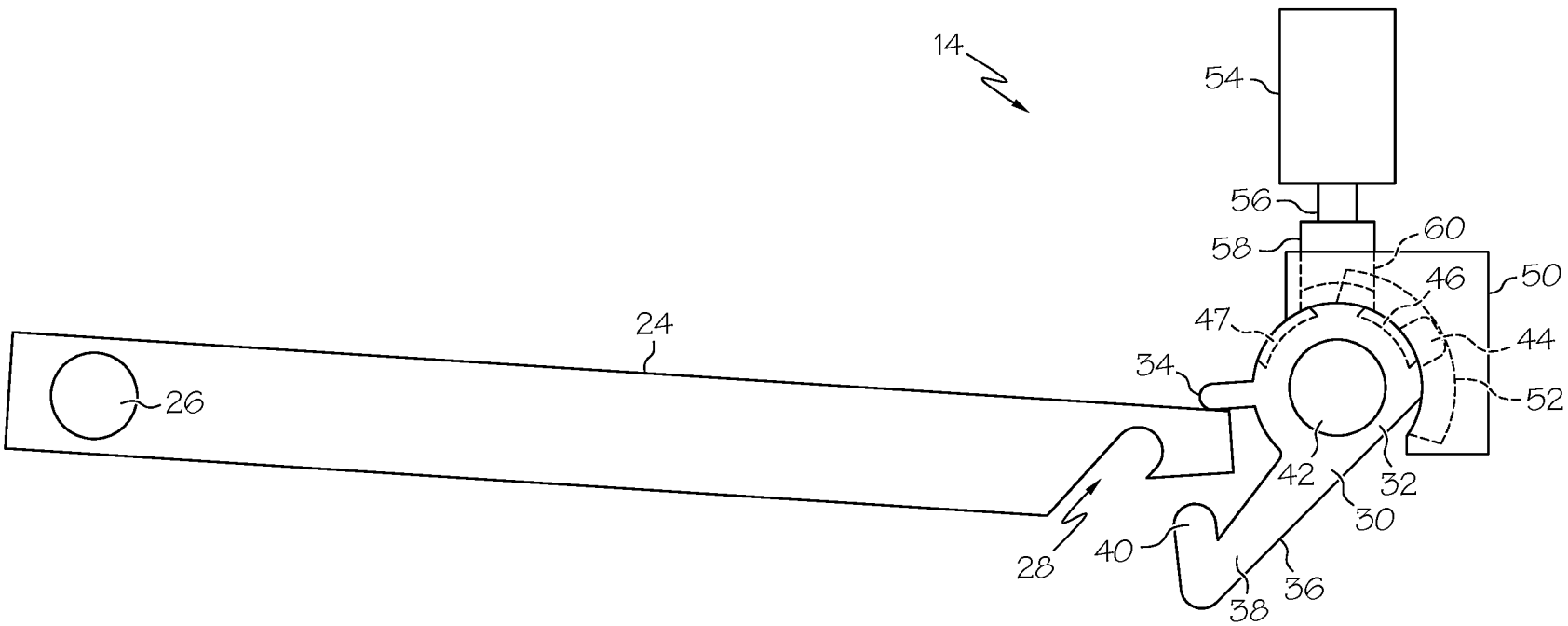
FIG. 12 is a top view of the door assembly of FIG. 11.

The handle 30 can then be pivoted by the user about the post 42 (counterclockwise in the embodiment shown in the drawings) until the rear tab 34 of the handle 30 engages the main panel 24, thereby pivoting the main panel 24 slightly open, as shown in FIGS. 11 and 12. The user can then further manually open the main panel 24, thereby gaining access to the associated inner compartment 12 of the storage cabinet 10, as shown in FIGS. 13-15.

Figure 13:
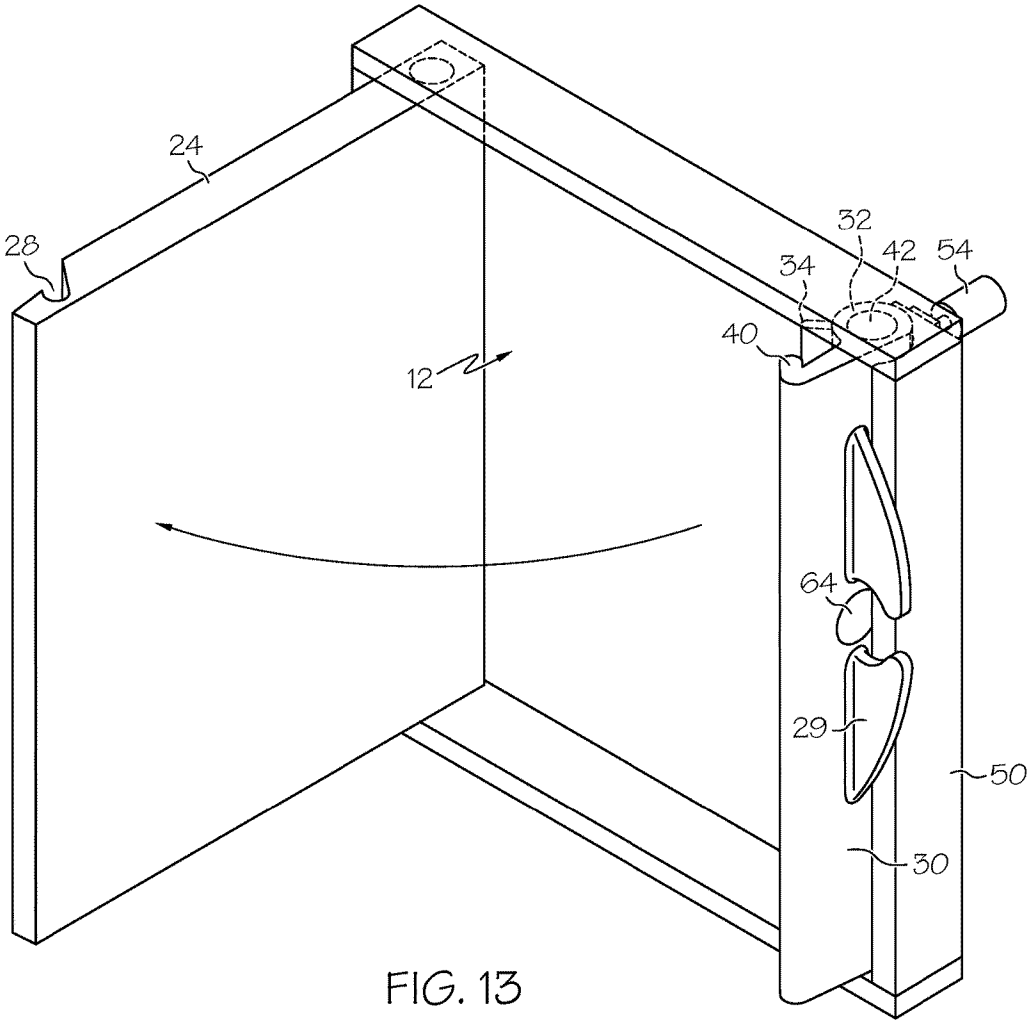
FIG. 13 shows the door assembly of FIG. 11, with the handle and main panel opened more fully.
Figure 14:
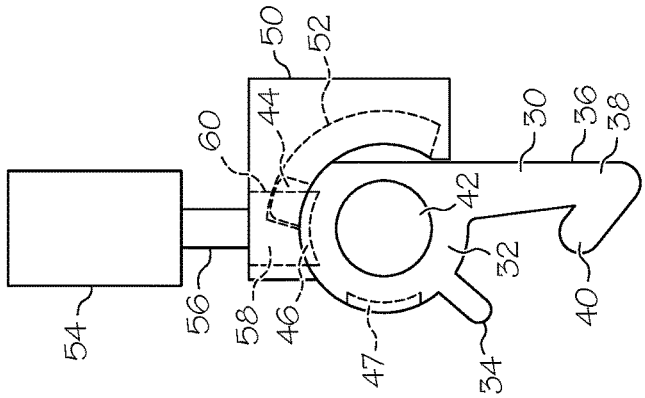
FIG. 14 is a top view of the door assembly of FIG. 13.
Figure 14:
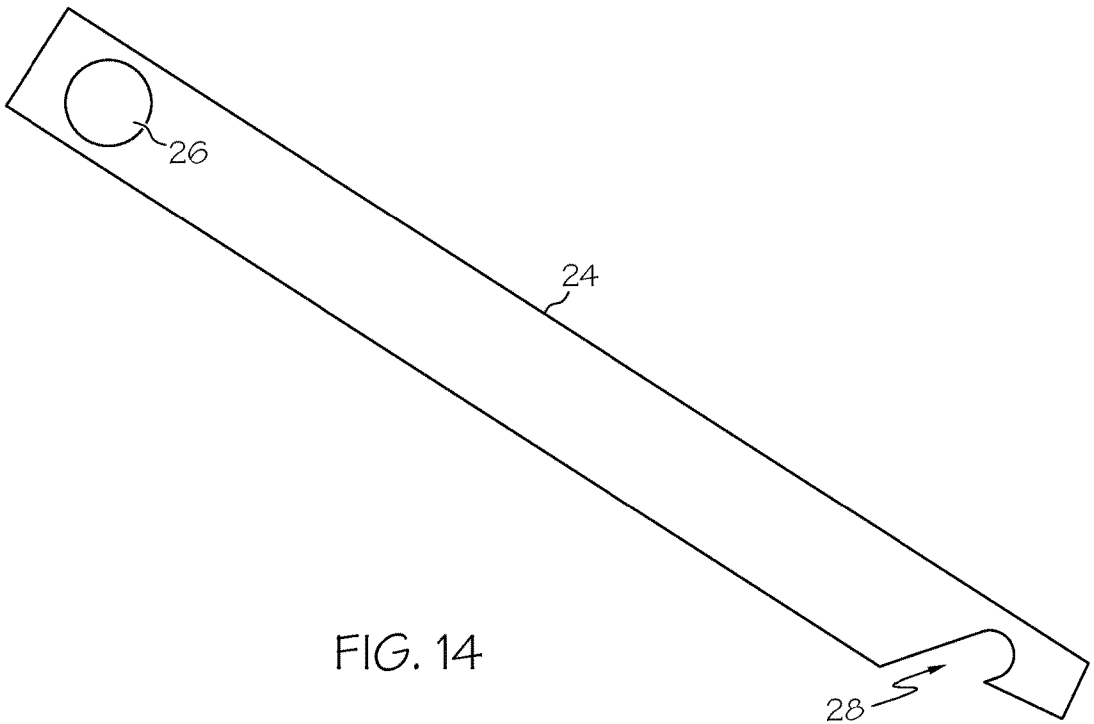

When the main panel 24 is sufficiently opened (e.g. in one case, opened beyond the partially open position shown in FIGS. 11 and 12), such opening may cause (via the kick plate 34) the handle 30 to pivot to its fully open position, as shown in FIGS. 13-16, in which case the handle 30 is pivoted 90 degrees from its closed position. In one embodiment, when the main panel 24 is opened in this manner, the door position sensor 62 may be triggered, thereby causing the solenoid 54 to switch off. In this case when the solenoid 54 is in its off state, as shown in FIG. 14, the plunger 56 returns to its extended/deployed position, pushing the plunger 58 into the recess 46 of the handle 30, thereby locking the handle 30 in place and preventing the handle 30 from pivoting. Thus the handle 30 is effectively secured in its fully open position. When the handle 30 is secured in its open position, the handle 30 blocks the main panel 24 from being closed, as the handle 30 (more particularly, the tab 34) physically blocks and interferes with attempting closing of the main panel 24.

This interaction between the main panel 24, door position sensor 62, solenoid 54 and handle 30 helps to ensure that the handle 30 is not returned to its closed position unless the main panel 24 is, also, returned to its closed position. Thus, this arrangement ensures that the door assembly 14 is not placed into a state wherein the main panel 24 remains unsecured in its open position when the handle 30 is closed, and thereby provides improved security.

Figure 15:
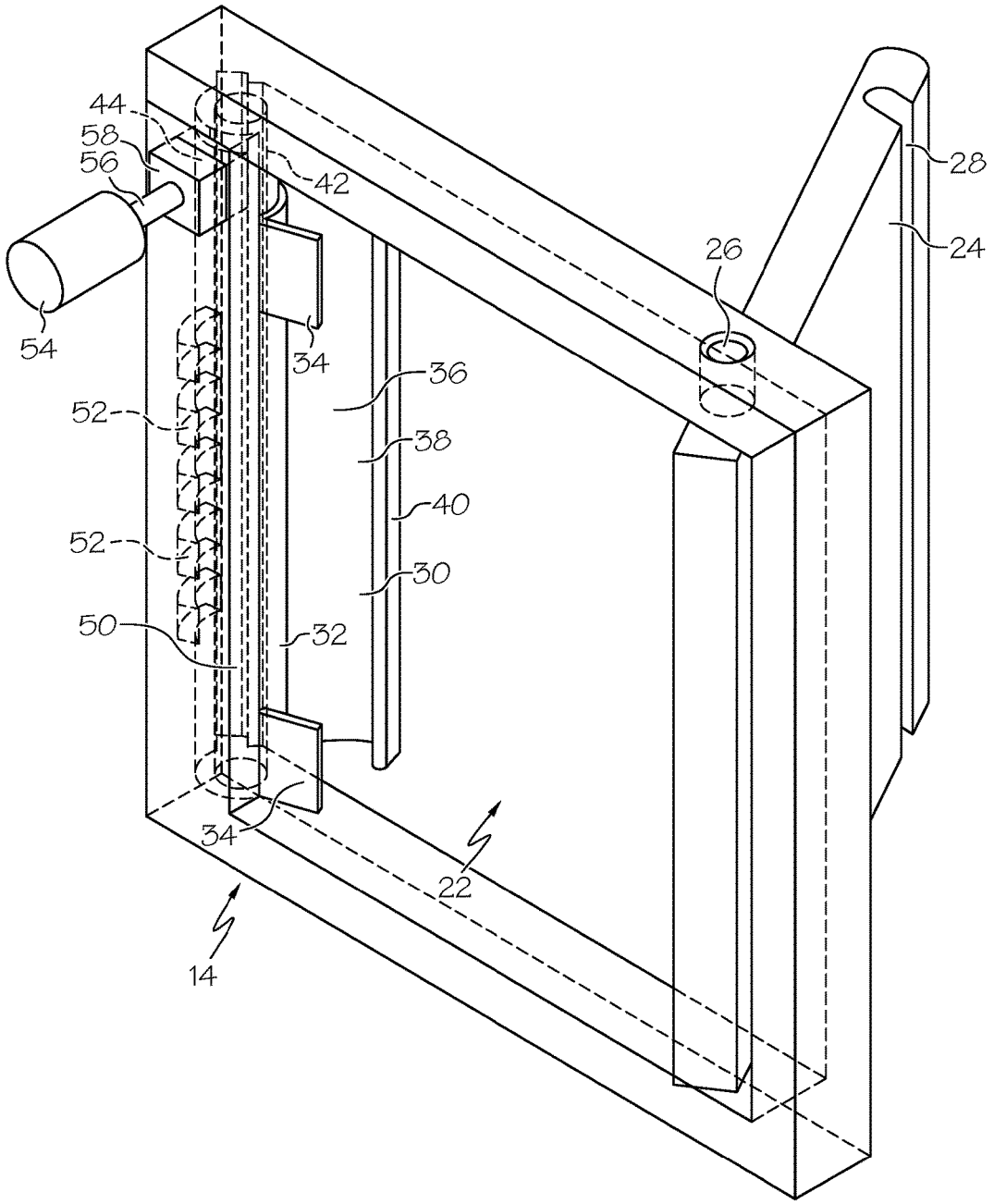
FIG. 15 is a rear perspective view of the door assembly of FIG. 13.
Figure 16:
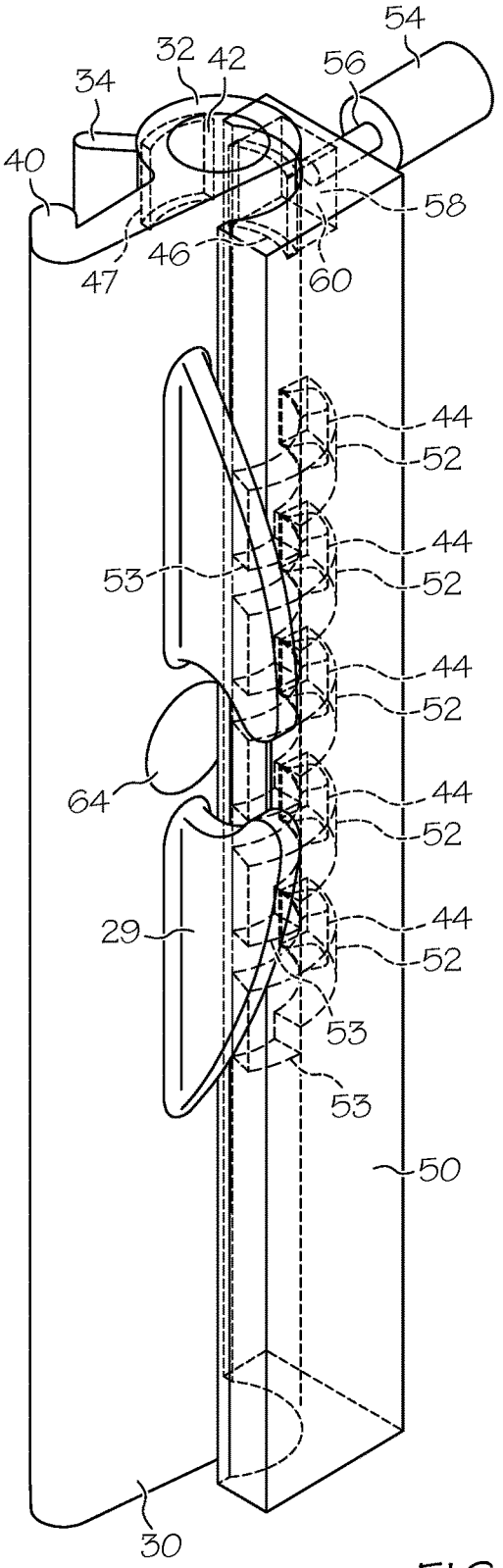
FIG. 16 is a front detailed perspective view the door assembly of FIG. 13, with the plunger extended.

When the door assembly 14 is fully opened, as shown in FIGS. 13-15, the user has access to the inner compartment 12 associated with that door assembly 14, and can access the inner compartment 12 to remove desired items therefrom, and/or place items therein, and freely move the main panel 24 (but not necessarily the handle 30).

When the user desires to close the door assembly 14, the main panel 24 is pivoted back toward its closed position. When the main panel 24 is sufficiently closed (i.e. in its nearly closed position), the door position sensor 62 senses that the main panel 24 is sufficiently closed and/or positioned adjacent to the handle 30. The solenoid 54 is then activated, thereby causing the pad 58 to be retracted out of the recess 46 of the handle 30. The controller 15 may have logic/software programmed therein to ensure that the solenoid 54 is activated at this point. In one embodiment, the solenoid 54 is activated at this time for a fixed period of time (i.e. about 5 seconds in one embodiment), to allow the user sufficient time to complete closing of the door assembly 14. The nearly-closed position can be a position in which the main panel 24 is less than about 30 degrees, or less than about 15 degrees, or less than about 5 degrees out-of-plane from its fully closed position; or wherein the main panel 24 is spaced apart from any part of the handle 30 by less than about two inches, or less than about one inch; or wherein the main panel 24 has engaged the kick plate 34 of the handle 30.

Figure 10:
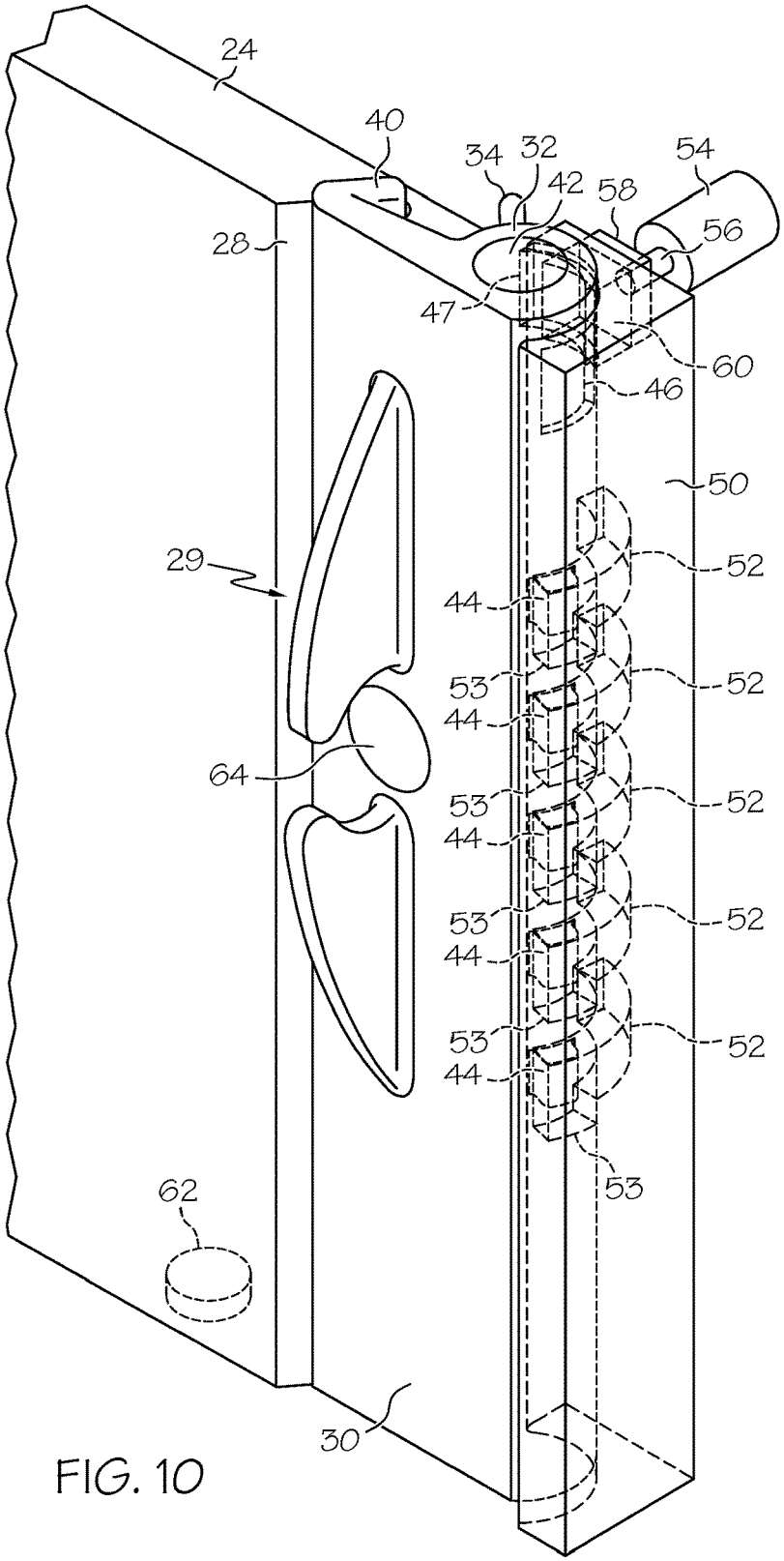
FIG. 10 shows the door assembly of FIG. 8, with the handle raised.

When the solenoid 54 is activated and the pad 58 is retracted out of the recess 46 the handle 30 is again free to pivot. The main panel 24 is then further closed by the user, engaging the rear tab 34 and causing the handle 30 to move into its closed position (FIGS. 9 and 10). Once the door assembly 14 is in the closed position, the handle 30 drops to its lower position (FIG. 8), and the solenoid 54 is deactivated (i.e. after the timer expires), thereby locking the handle 30 and main panel 24 in their closed positions, and also switching off the light source 64. The door assembly 14 is thus configured such that the main panel 24 is prevented from moving to its closed position unless the handle 30 is simultaneously moved to its closed position. In other words, as can be seen in comparing the various dimensions of FIG. 14, if the main panel 24 were attempted to be closed, the main panel 24 would engage the kick plate 34; it is only when the handle 30 is also moved to its closed position that the main panel 24 can be closed.

Accordingly, the door assembly 14, as outlined above, provides easy and intuitive operation by a user, and also provides fail-safe operation to ensure that the handle 30 is locked in its open position when the main panel 24 is open, and is locked in its closed position only when the main panel 24 is also in its closed position. In addition, the door assembly 14 provides an arrangement which is theft and tamper resistant. In particular, as noted above the locking portion 40 of the handle 30 fits into the notch 28 of the main panel 24, generally filling the notch 28. The block 50 also helps to generally cover any gap between the handle 30 and the frame 18. This arrangement helps to reduce or eliminate any crevices, into which a crowbar, pry bar or the like can be wedged to force the door assembly 14 open. The bottom portion 29*b* of the gripping portion 29 helps to protect and secure the door assembly 14, as it prevents unauthorized entry/breakage of the handle 30 which can be caused by an upward strike on the bottom surface of the upper portion 29*b*, for example with a heavy tool.

As noted above and shown in FIGS. 2 and 18, in one embodiment, each door assembly 14 may be part of a door panel 16 having the door panel frame 18 and a plurality of door assemblies 14 mounted thereto. In addition, the solenoid 54 and door position sensor 62 for each door assembly is mounted on or to the door panel frame 18.

Figure 18:
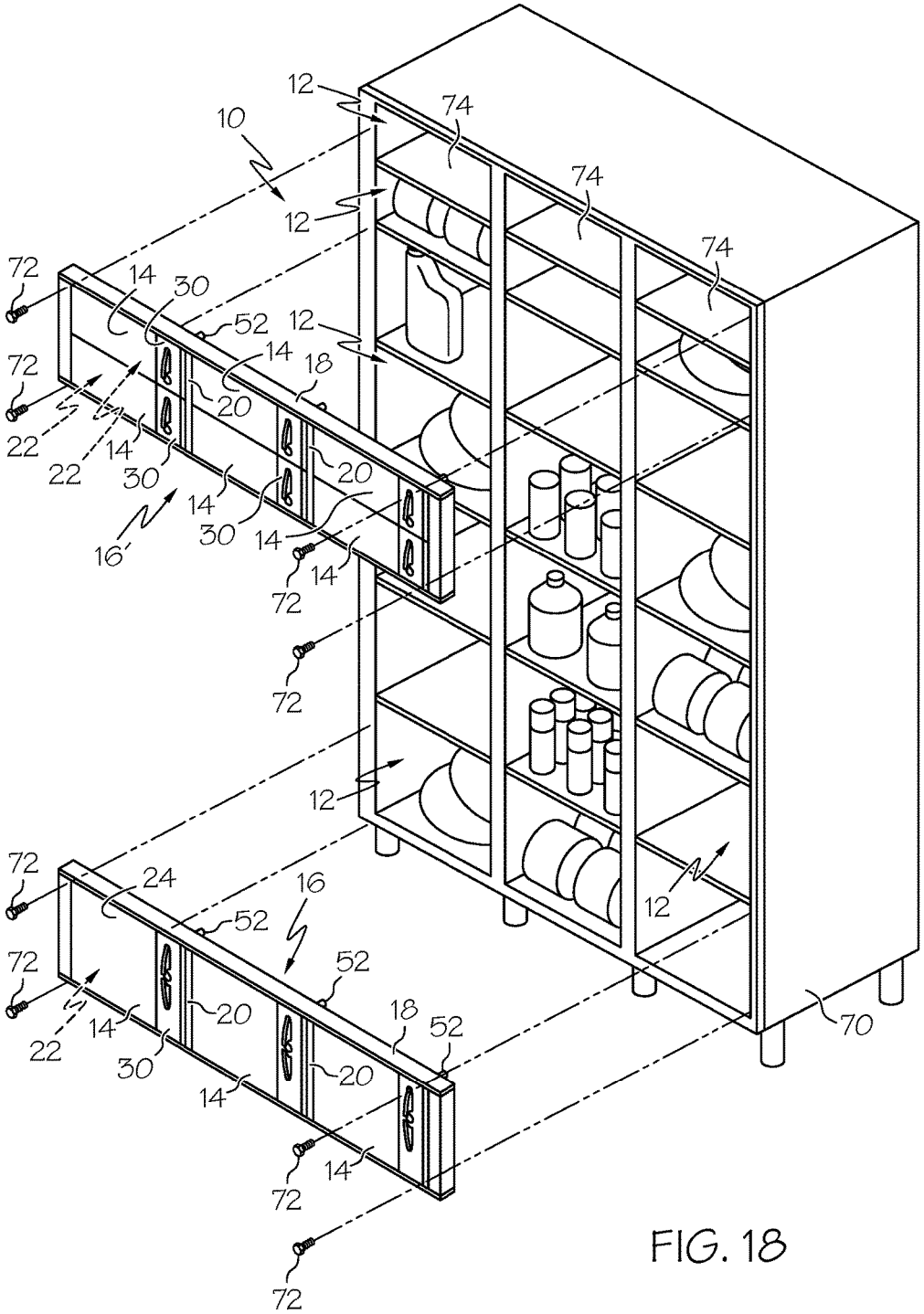
FIG. 18 is a front perspective exploded view of a storage cabinet, showing two exploded door panels.

As shown in FIG. 18, each door panel 16 may be mounted to the frame 70 of the storage cabinet 10 by a plurality of fasteners 72 extending through the frame 18 and received in the frame 70. In one particular embodiment, each fastener 72 may take the form of a safety fastener, safety screw or the like, which has particular head design such that each fastener 72 can be screwed and unscrewed, or inserted or retracted, only with a specialized, and not-commonly-available, tool. The use of such safety screws 72 helps to provide increased security to the storage cabinet 10 and avoid tampering therewith. In some cases the safety screws 72 may be of a tamper-evident nature so that the owner/operator can notice when the safety screws 72 have been removed. The tamper-evident feature can be provided by any wide variety of devices, such as stickers covering the screws, a frangible or easily-removable coating, frangible washers or the like.

In some cases, the owner/operator of the storage cabinet 10 have an appropriate tool on hand and thus be able to remove a door panel 16 and gain access to the storage compartments 12 of the storage cabinet 10 on, for example, an emergency basis. This feature provides manual override functionality to the system 10 should the controller 15, keypad 17 or solenoid 54 malfunction, or in the case of a power loss, etc.

The use of the door panel 16 also provides a modular arrangement to the storage cabinet 10. In particular, in the embodiment shown in FIG. 1 it can been seen that the storage cabinet 10 includes six rows and three columns of openings 22/door assemblies 14/storage compartments 12, and each door panel 16 provides a row of three door assemblies 14. As shown in FIG. 18, in one case, an alternate door panel 16', utilizing door assemblies 14 that are half the height of the other door assemblies 14, can be utilized. In this case, divider panels 74 can be slid into the appropriate storage compartments 12 so that the size of the storage compartments 12 and door assemblies 14 properly correspond. Of course, the storage compartments 12/door assemblies 14 can take any of a variety of other shapes and configurations.

Each door panel 16 can be provided with any number of desired door assemblies 14, in a desired spacing and configuration, to match the user's desires, as well as the configuration of the frame 70/compartments 12 of the storage cabinet 10. The door panels 16 may also be arranged vertically or in other configurations. Thus it can be seen that the door panels 16 provide a modular assembly in which the various components can be mixed and matched as desired to provide the desired system.

The door panels 16 also allow for ease of access for repair and/or replacement. In particular, should the handle 30, latch mechanism, solenoid 52 or other components of a door assembly 14 require repair, maintenance or replacement, the door panel 16 can be easily removed, thereby exposing the handle 30, latch mechanism, solenoid 52 and the like for easy access. Once the door assembly 14 has been repaired, or a replacement door panel 16 has been is obtained, the door panel 16 can be easily re-attached to the storage cabinet 10.

Although the invention is shown and described with respect to certain embodiments, it should be clear that modifications will occur to those skilled in the art upon reading and understanding the specification, and the present invention includes all such modifications.

What is claimed is:

1. A storage and dispensing system comprising:

a storage device frame defining a plurality of compartments;

a door assembly including a door assembly frame and a plurality of doors coupled thereto, each door being sized to generally correspond to one of said compartments of said storage device frame to selectively provide access thereto, wherein said door assembly frame is removably coupleable to said storage device frame; and an electronic controller coupled to said storage device frame, wherein said controller is operatively coupleable to said door assembly so that said controller can thereby control at least one of locking or unlocking of each door of said door assembly.

2. The system of claim 1 wherein said storage device frame includes an array of compartments having more than one of at least a row or column, and wherein said plurality of doors includes doors configured to cover at least an entire row or column of compartments when said door assembly is removably coupled to said storage device frame.

3. The system of claim 1 wherein each compartment is generally closed and includes an end opening defined by structure of said storage device frame extending entirely about said end opening, and wherein each door has a size and shape generally corresponding to an associated end opening to control access thereto when said door assembly is removably coupled to said storage device frame.

4. The system of claim 1 wherein storage device frame has compartments of a first size and compartments of a second size, and wherein said door assembly has doors sized to generally correspond to said compartments of said first size, and wherein the system further includes a supplemental door assembly including a plurality of doors sized to generally correspond to said compartments of said second size, wherein said supplemental door assembly is removably coupleable to said storage device frame.

5. The system of claim 1 wherein each door is pivotally mounted to said door assembly frame.

6. The system of claim 5 wherein said door assembly frame includes a block positioned between adjacent ones of said doors, wherein each door is pivotable about an axis, and wherein each door is directly or indirectly securable to an associated block positioned on an opposite side of said door relative to the associated axis.

7. The system of claim 1 wherein said door assembly includes a solenoid, transducer or other electrically activatable component operatively coupled to at least one door and configured to selectively lock or unlock said at least one door.

8. The system of claim 7 wherein said controller is operatively coupled to said solenoid, transducer or other electrically activatable component.

9. The system of claim 1 wherein said door assembly includes a plurality of solenoids, each solenoid being operatively coupled to an associated door and configured to selectively lock or unlock said associated door.

10. The system of claim 1 wherein said plurality of doors are arranged in only a single row or column.

11. The system of claim 1 wherein said plurality of doors are arranged in an array having more than one of at least a row or column.

12. The system of claim 1 wherein said door assembly includes at least three doors.

13. The system of claim 1 wherein each door is pivotally coupled to said door assembly frame, and wherein said door assembly frame is removably coupleable to said storage device frame to thereby removably couple said doors to said storage device frame.

14. The system of claim 1 wherein each door includes:

a first panel movable between a closed position in which said first panel generally covers a first portion of said compartment and an open position in which said first panel generally does not cover said first portion; and a second panel pivotable about an axis between a closed position in which said second panel generally covers a second portion of said compartment and an open position in which said second panel generally does not cover said second portion, and wherein said second panel is lockable in its closed position to block the first panel from moving from its closed position to its open position, and wherein said second panel is movable along said axis to either lock or unlock said second panel.

15. The system of claim 1 wherein the door assembly has a plurality of locks, each of which is operatively coupleable to said controller and configured to selectively block or allow opening of the associated door.

16. The system of claim 1 wherein the controller is operatively coupleable to said door assembly when said door assembly is coupled to said storage device frame.

17. The system of claim 1 wherein said door assembly is removably coupled to said storage device frame and controller is operatively coupled to said door assembly.

18. The system of claim 1 wherein the door assembly is configured to be removably coupled to the storage device frame with a plurality of safety fasteners.

19. The system of claim 1 wherein the controller is directly coupled to said storage device frame and not directly coupled to said door assembly frame.

20. A method for manipulating a system comprising:

accessing a storage and dispensing system including a storage device frame defining a plurality of compartments;

accessing a door assembly including a door assembly frame, a plurality of doors coupled thereto, and a solenoid, transducer or other electrically activatable component operatively coupled to at least one door to selectively lock or unlock said at least one door; and removably mounting said door assembly to said storage device frame such that each door generally controls access to one of said compartments of said storage device frame.

21. A storage and dispensing system comprising:

a storage device defining a plurality of compartments;

a door assembly including a door assembly frame and a plurality of doors coupled thereto, wherein said door assembly is removably coupleable to said storage device and;

a solenoid, transducer or other electrically activatable component coupled to said door assembly and operatively coupled to at least one door to selectively lock or unlock said at least one door.

22. The system of claim 21 wherein each door is sized to generally correspond to one of said compartments of said storage device to selectively provide access thereto.

23. The system of claim 21 further comprising an electronic controller coupled to said storage device, wherein said controller is operatively coupleable to said solenoid, transducer or other electrically activatable component to thereby control said selective locking or unlocking of said at least one door.

24. The system of claim 21 wherein said solenoid, transducer or other electrically activatable component is operatively coupled to each door.

* * * * *